US006215463B1

(12) United States Patent
Matsumoto et al.

(10) Patent No.: US 6,215,463 B1
(45) Date of Patent: Apr. 10, 2001

(54) DRIVING SYSTEM FOR A DISPLAY PANEL

(75) Inventors: Yukihiro Matsumoto; Shigeo Ide, both of Yamanashi-ken (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/145,414

(22) Filed: Sep. 1, 1998

(30) Foreign Application Priority Data

Sep. 2, 1997 (JP) ..... 9-252861

(51) Int. Cl.[7] ..... G09G 3/30; G09G 3/28
(52) U.S. Cl. ..... 345/80; 345/67; 345/68
(58) Field of Search ..... 345/211, 67–68, 345/80

(56) References Cited

U.S. PATENT DOCUMENTS 5,717,437 * 2/1998 Sano et al. ..... 345/211

* cited by examiner

*Primary Examiner*—Richard Hjerpe
*Assistant Examiner*—Duc Dinh
(74) *Attorney, Agent, or Firm*—Arent Fox Kintner Plotkin & Kahn, PLLC

(57) ABSTRACT

A data voltage source circuit is provided for applying column electrode driving voltage to a column electrode driver. The data voltage source circuit has a voltage source for supplying column electrode driving voltage of about one half of a maximum voltage for driving the column electrode, a diode provided between the voltage source and an output terminal, a first switch and a second switch, and a voltage adding capacitor provided between a junction of the first and second switches and the output terminal. The column driver has an input terminal connected to the output terminal of the data voltage source circuit, a plurality of output terminals connected to the column electrodes, a third switch, and a fourth switch. A control circuit is provided for producing control signals for controlling the first to fourth switches. The control signals control ON/OFF operations of first to fourth switches for stepwisely applying the column electrode driving voltage of one half of the maximum voltage and the maximum voltage.

3 Claims, 4 Drawing Sheets

DRIVING SYSTEM FOR A DISPLAY PANEL

BACKGROUND OF THE INVENTION

The present invention relates to a driving system of a matrix display system used as a display for an information terminal device, personal computer, and television receiver, and having such a display panel as an alternative current plasma display panel (ACPDP), electroluminescence (EL) panel, and liquid crystal panel wherein capacitive load is generated, and more particularly to a system wherein power for applying pixel data pulses to capacitive column electrodes is effectively reduced.

Recently, as a display device becomes large in size, thickness of the display device is desired to be thin. Therefore, various types of display devices of thin thickness are provided. As one of the display devices, an ACPDP is known.

A conventional ACPDP comprises a plurality of column electrodes and a plurality of row electrodes formed in pairs and disposed to intersect the column electrodes. A pair of row electrodes form one row (one scanning line) of an image. The column electrodes and the row electrodes are covered by dielectric layers respectively, at a discharge space. At the intersection of each of the column electrodes and each pair of row electrodes, a discharge cell (pixel) is formed.

FIG. 4 shows a timing chart of drive signals for driving the conventional ACPDP.

A reset pulse RPx of negative polarity is applied to each of the row electrodes X1–Xn. At the same time, a reset pulse RPy of positive polarity is applied to each of the row electrodes Y1–Yn. Thus, all of the row electrodes in pairs in the PDP are excited so that discharge occurs in each discharge cell, thereby producing charged particles in the discharge cell. Thereafter, when the discharge is finished, wall charge is formed and accumulated on the discharge cell (A reset all at once period).

Then, pixel data pulses AP1–APn corresponding to the pixel data for every row are applied to the column electrodes A1–Am in order in accordance with display data. At that time, scanning pulses (selecting and erasing pulses) SP are applied to the row electrodes Y1–Yn in order in synchronism with the timings of the data pulse AP1–APn.

At the time, only in the discharge cell (non-lighting pixel) to which the scanning pulse SP and the pixel data pulse AP are simultaneously applied, the discharge occurs, so that the wall charge produced at the reset all at once period is erased.

On the other hand, in the discharge cell to which only the scanning pulse SP is applied, the discharge does not occur. Thus, the wall charge produced at the reset all at once period is held. Namely, a predetermined amount of the wall charge is selectively erased in accordance with the pixel data (An address period).

Next, a discharge sustaining pulse IPx of negative polarity is applied to the row electrodes X1–Xn, and a discharge sustaining pulse IPy of negative polarity is applied to the row electrodes Y1–Yn at offset timing from the discharge row pulses IPx.

During the discharge sustaining pulses are continuously applied, the discharge cell which holds the a wall charge sustains the discharge and emission of light (A discharge sustaining period). On the other hand, a discharge cell in which the wall charge is erased does not emit.

Then, wall charge erasing pulses EP are applied to the row electrodes Y1–Yn for erasing the wall charges formed in all discharge cells.

By repeating the cycle comprising the reset all at once period, address period, discharge sustaining period, and wall charge erasing period, the pixel display is performed.

In such a driving system, there may be generated a potential difference between a column electrode to which a pixel data pulse is applied and an adjacent column electrode to which no pixel data pulse is applied during the address period. Therefore, a parasitic capacity between the adjacent column electrodes must be charged and discharged every time the pixel data is written on the scanning line. As a result, reactive power generates. In the case where only a single color, namely, red, green or blue is shown on the display, the reactive power is increased so that a large power for writing pixel data is required in addition to the power necessary for displaying. Hence the power consumption is increased.

In order to decrease the parasitic capacitance, which causes the increase in power consumption as described above, it is necessary to increase the distance between column electrodes, which renders it difficult to produce a extremely fine display panel.

SUMMARY OF THE INVENTION

An object of the present invention is to provide a driving system for a display panel wherein the power consumption is reduced and the fine the display panel is still achieved.

According to the present invention, there is provided a driving system for a display panel having a plurality of row electrodes, a plurality of column electrodes intersecting with the row electrodes, comprising, a data voltage source circuit having a voltage source for supplying a voltage of about one half of a maximum voltage for driving the column electrode, a diode provided between the voltage source and an output terminal, a first switch connected to the voltage source at an end thereof, a second switch connected to another end of the first switch at an end thereof, and to a ground at the other end, and a voltage adding capacitor provided between a junction of the first and second switches and the output terminal, a column driver for driving the column electrodes, the column driver having an input terminal connected to the output terminal of the data voltage source circuit, a plurality of output terminals connected to the column electrodes, a third switch provided between the input terminal and each of the output terminals, a fourth switch provided between each of the output terminals and a ground, control circuit means for producing control signals for controlling the first to fourth switches.

These and other objects and features of the present invention will become more apparent from the following detailed description with reference to the accompanying drawings.

DETAILED DESCRIPTION OF THE PREFERRED EMBODIMENTS

Figure 1:
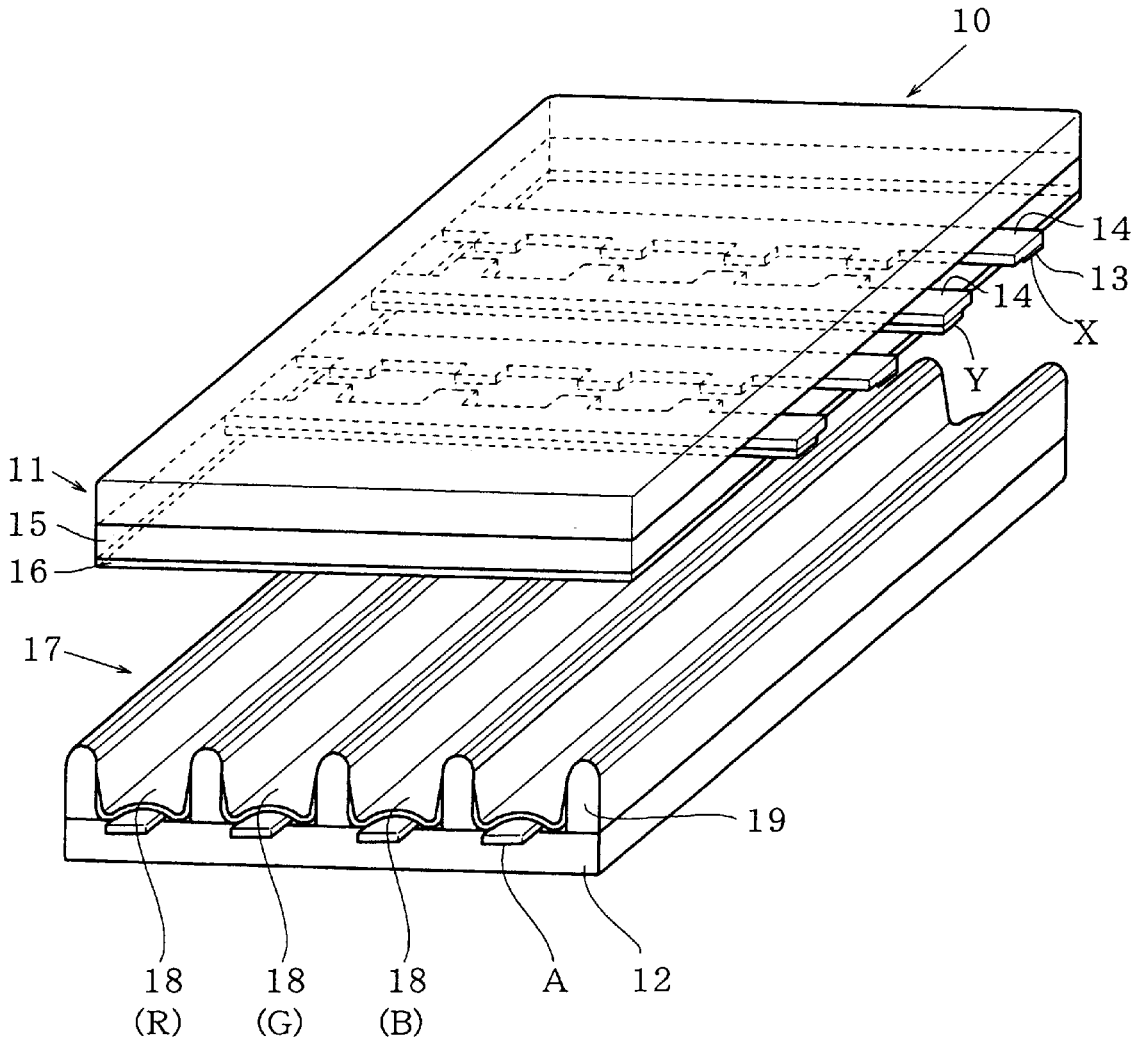
FIG. 1 is a schematic perspective view showing a plasma display panel driven by the present invention.

FIG. 1 shows an ACPDP 10 of a reflection type to which the present invention is applied. The ACPDP 10 comprises a pair of glass substrates 11 and 12 disposed opposite to each other, interposing a discharge space 17 therebetween. The glass substrate 11 as a display portion has row electrodes (sustain electrodes) X and Y which are alternately disposed in pairs to be parallel with each other at the inside portion thereof. The row electrodes X and Y are covered by a dielectric layer 15 for producing wall charge. A protection layer 16 made of MgO is coated on the dielectric layer 15.

Each of the row electrodes X and Y comprises a transparent electrode 14 formed by a transparent conductive film having a large width and a bus electrode (metallic electrode) 13 formed by a metallic film having a small width and layered on the transparent electrode 14.

On the glass substrate 12 as a rear member, a plurality of elongated barriers 19 are provided at the inside portion thereof for defining the discharge space 17. The barrier 19 extends in the direction perpendicular to the row electrodes X, Y. Between the barriers 19, column electrodes (address electrodes) A are formed to intersect the row electrodes X and Y of the glass substrate 11. A phosphor layer 18 having a predetermined luminous color R, G or B covers each of the column electrodes D and opposite side portions of the barrier 19. The discharge space 17 is filled with discharge gas which is a mixture of neon and a small quantity of xenon. Thus, a pixel (including a discharge cell) is formed at the intersection of the row electrodes X and Y on the glass substrate 11 and the column electrode A on the glass substrate 12. Since the ACPDP having a plurality of pixels is formed, it is possible to display images.

Figure 2:
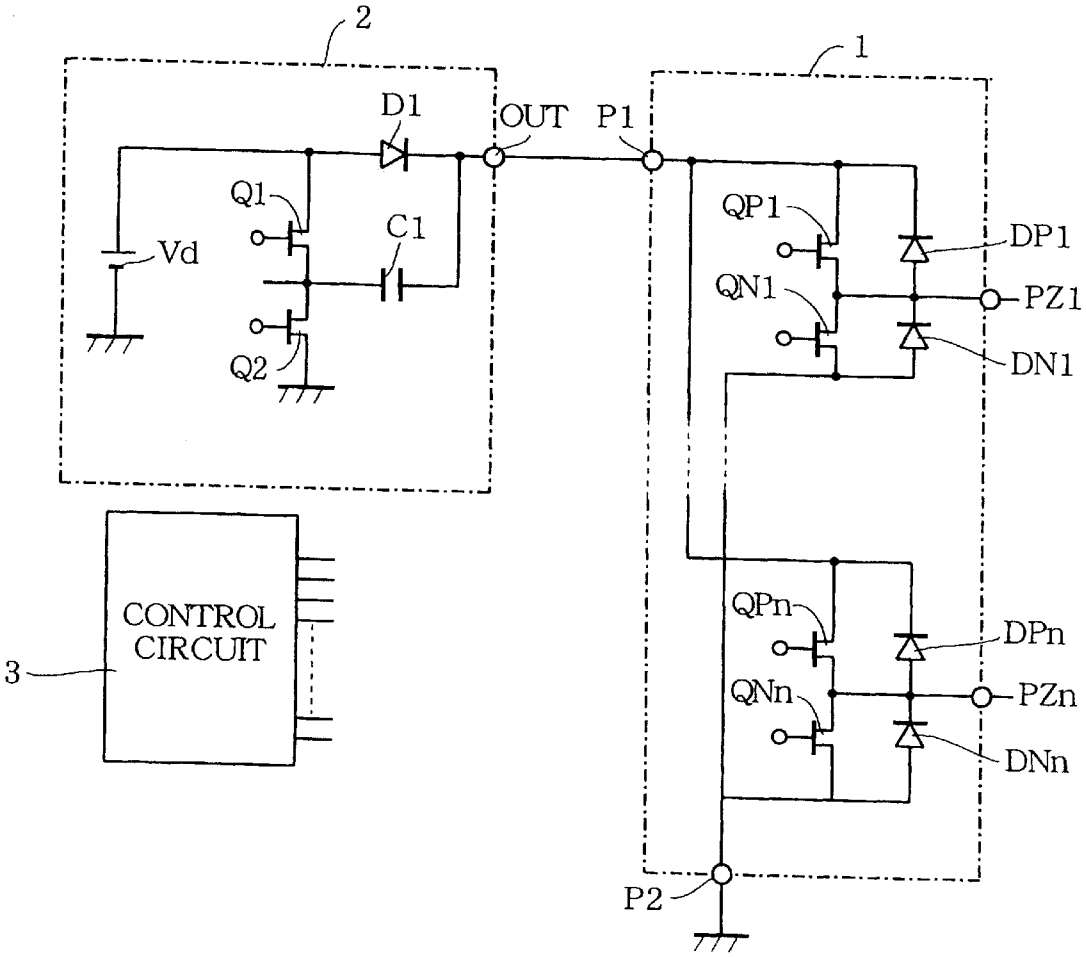
FIG. 2 is a diagram showing a circuitry of a system for driving the display panel.

Referring to FIG. 2, an embodiment of a driving system for driving the PDP shown in FIG. 1 comprises a driver IC 1 for driving the column electrodes, data voltage source circuit 2 for driving the driving IC, and a control circuit 3 for controlling the operation of the driver IC 1 and the data voltage source circuit 2.

The data voltage source circuit 2 has a constant voltage source Vd for supplying a constant voltage which corresponds to about one half of the maximum voltage V of the pixel data pulses AP. The data voltage source circuit 2 further comprises a p-channel field-effect transistor (FET) Q1 as a first switching means, n-channel FET Q2 as a second switching means, and a diode D1. One terminal of the p-channel FET Q1 is connected to the constant voltage source Vd while the other terminal is connected to an output terminal OUT through a capacitor C1 for adding voltages. One terminal of the n-channel FET Q2 is also connected to the output terminal OUT through the capacitor C1 while the other terminal is grounded. The power from the source Vd is applied to an input terminal P1 of the driver IC 1 through the diode D1 and the output terminal OUT.

The driver IC 1 has the input terminal P1 connected to the output terminal OUT of data voltage source circuit 2, a plurality of output terminals PZ1 to PZn, each of which is connected to one of the column electrodes of the PDP, and a ground terminal P2.

The input terminal P1 is connected to a plurality of high-voltage resistive p-channel MOSFETs QP1 to QPn provided as a third switching means. The other terminals of the MOSFETs QP1 to QPn are connected to respective output terminals PZ1 to PZn. A plurality of high-voltage resistive n-channel MOSFTs QN1 to QNn are provided between the corresponding output terminals PZ1 to PZn and the ground terminal P2 as a fourth switching means.

Diodes DP1 to DPn are provided as parasitic diodes for the p-channel MOSFETs and diodes DN1 to DNn are provided as parasitic diodes for the n-channel MOSFETs. The output terminals PZ1 to PZn are connected to column electrodes to which data are to be applied.

The control circuit 3 applies control signals to the p-channel FET Q1 and the n-channel FET Q2 of the data voltage source circuit 2, p-channel MOSFETs QP1 to QPn and n-channel MOSFETs QN1 to QNn, thereby to control the operation of the switching means comprising the FETs.

The operation of the driving system will be described hereinafter with reference to FIG. 3 in which voltage levels in the devices of FIG. 2 are shown.

When the FET Q1 in the data voltage source circuit 2 is rendered OFF and the FET Q2 ON, a predetermined electric charge from the constant voltage source Vd is applied to the capacitor C1 through the diode D1, thereby storing the charge in the capacitor C1. Hence the capacitor C1 is charged with the constant voltage which is one half (V/2) of the maximum voltage V of the pixel data pulse AP.

While the FET Q1 is and the FET Q2 is ON, the voltage level at the input terminal P1 of the driving IC 1 is at V/2, namely at about one half of the maximum voltage V of the pixel data pulse AP. The control circuit 3 applies control signals to render ON p-channel MOSFETs QPi, wherein i represents integers from 1 to n, selected from the MOSFETs QP1 to QPn. At the same time, corresponding n-channel MOSFETs QNi are rendered OFF. Accordingly, the voltage level at each of the respective output terminals PZi rises from zero (first voltage level) to V/2 (second voltage level). Hence the column electrodes to which the data are to be applied are charged through the diode D1 of the data voltage source circuit 2 and the respective MOSFETs QPi.

When the FET Q1 is rendered ON and the FET Q2 OFF in response to the control signals from the control circuit 3, the voltage V/2 stored in the capacitor C1 is added to the voltage V/2 applied to the input terminal P1 through the diode D1. As a result, the voltage level at the input terminal P1 becomes the maximum voltage V (third voltage level), thereby raising the voltage level at each of the output terminal PZi to the voltage V.

When the FET Q1 of the data voltage source circuit 2 is rendered OFF and the FET Q2 ON in response to the control signals from the control circuit 3, the capacitor C1 is applied with the predetermined charge from the constant voltage source Vd through the diode D1 to be charged with the voltage V/2. At that time, the voltage level at the input terminal P1 is decreased to the voltage V/2, thereby lowering the voltage level at each of the output terminal PZi to V/2.

With further operations of the MOSFETs QPi and Qpn, namely, rendering the MOSFETs QPi OFF and MOSFETs QNi ON, the voltage level at each output terminal PZi is further decreased from V/2 to zero.

Figure 3:
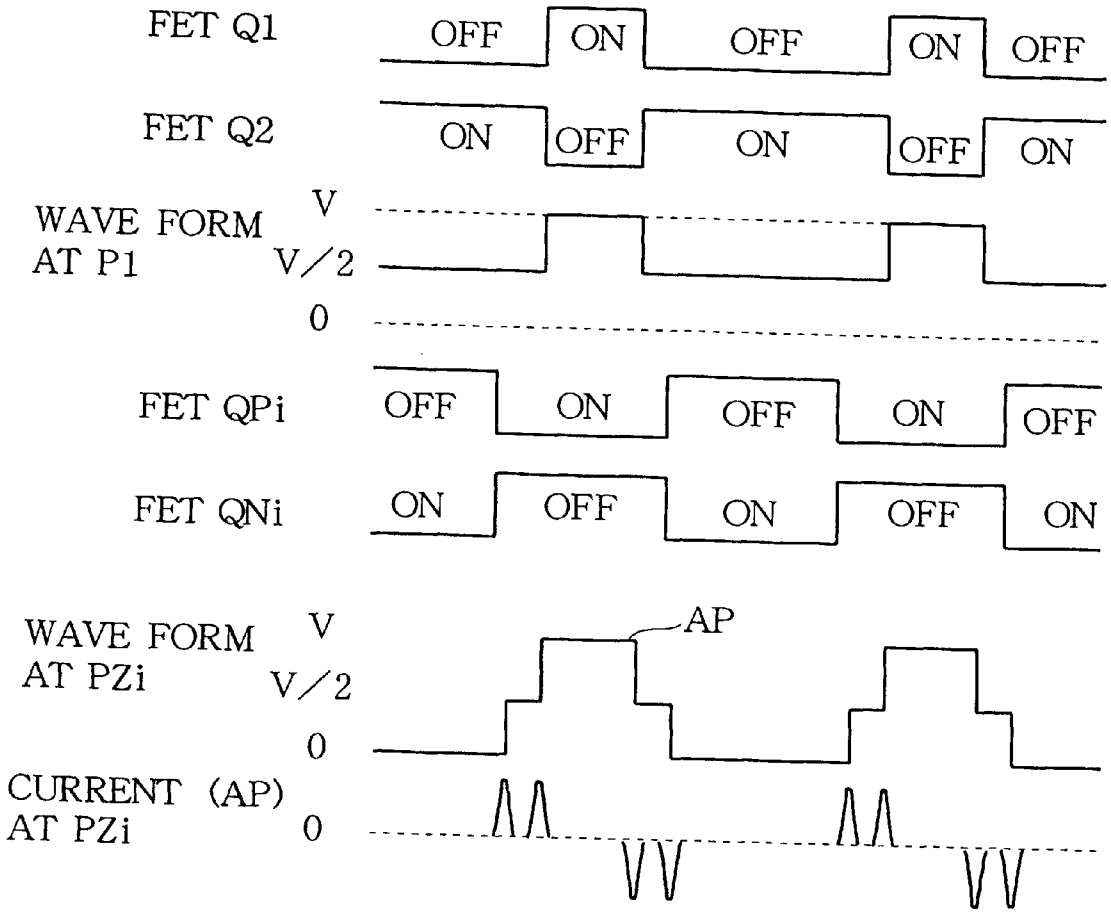
FIG. 3 is time charts explaining the operation of the driving system of FIG. 2.
Figure 4:
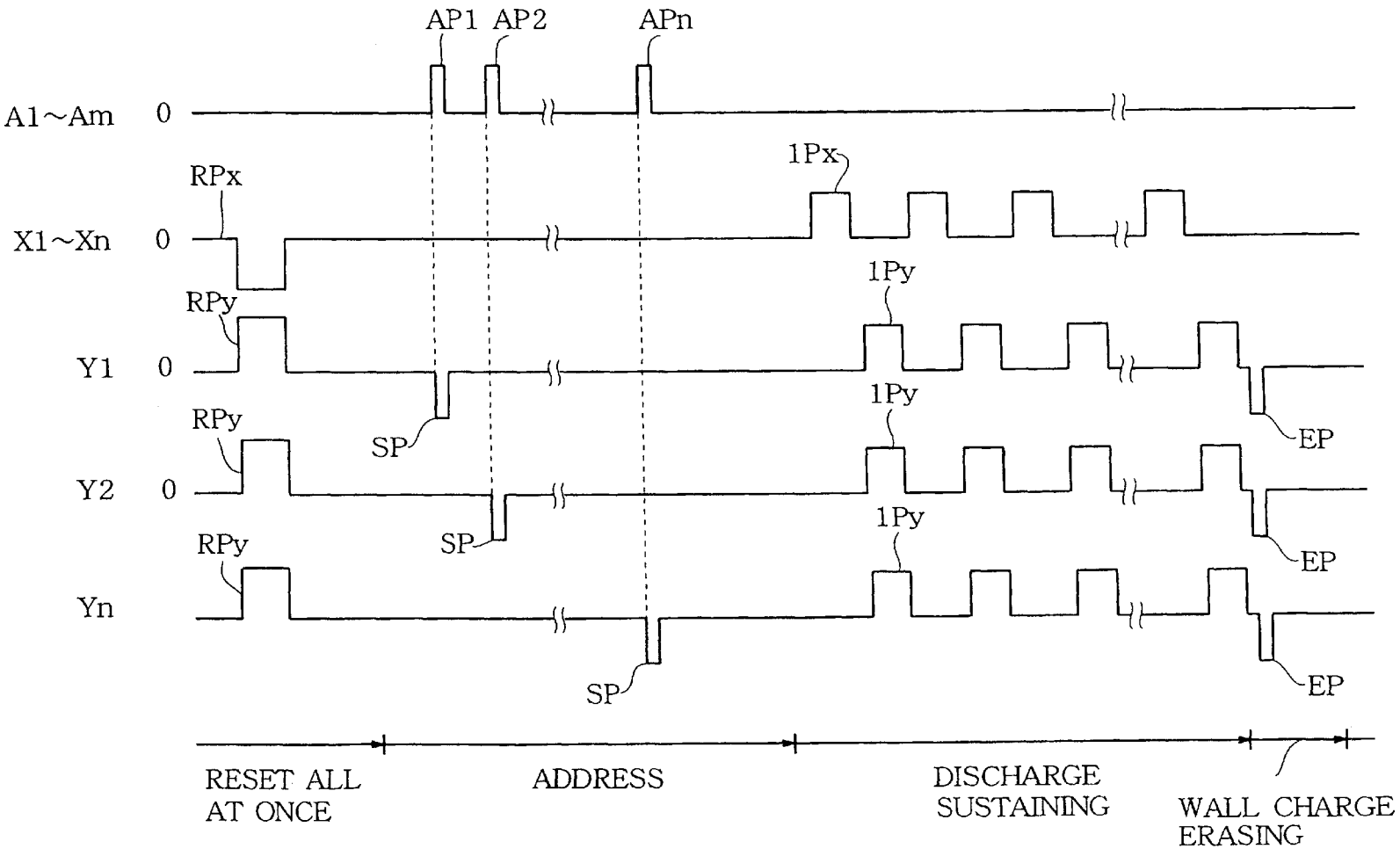
FIG. 4 is time charts showing drive signals for a conventional plasma display panel.

The pixel data pulses AP are thus generated as shown by the waveform in FIG. 3 in accordance with the operations of the FETs Q1 and Q2 and MOSFETs QPi and QNi. Since the current (AP) is one half of that of the conventional system, the power consumption is decreased to one half of that of the conventional driving system. In addition, since the peak current flowing through the output terminal PZi is divided into two, unwanted radiation (electromagnetic wave of high frequency as noises) can be restrained.

In accordance with the present invention, the driving system is provided with the capacitor for storing voltage, so that the voltage applied through the switching means to the driving IC for generating the pixel data pulses can be selectively changed between the constant voltage supplied from the constant voltage source and the double of the constant voltage by adding the voltage charged in the capacitor. Hence the power for driving the capacitive column electrodes when applying pixel data thereto can be effectively reduced.

While the invention has been described in conjunction with preferred specific embodiment thereof, it will be understood that this description is intended to illustrate and not limit the scope of the invention, which is defined by the following claims.

What is claimed is:

1. A driving system for a display panel having a plurality of row electrodes, a plurality of column electrodes intersecting with the row electrodes, comprising:

a data voltage source circuit having a voltage source for supplying a voltage of about one half of a maximum voltage for driving the column electrode, a diode provided between the voltage source and an output terminal, a first switch connected to the voltage source at an end thereof, a second switch connected to another end of the first switch at an end thereof, and to a ground at the other end, and a voltage adding capacitor provided between a junction of the first and second switches and the output terminal;

a column driver for driving the column electrodes, the column driver having an input terminal connected to the output terminal of the data voltage source circuit, a plurality of output terminals connected to the column electrodes, a third switch provided between the input terminal and each of the output terminals, a fourth switch provided between each of the output terminals and a ground, control circuit means for producing control signals for controlling the first to fourth switches.

2. The system according to claim 1 wherein the control circuit means produces first control signals for changing the third switch from OFF to ON, the fourth switch from ON to OFF when the first switch is OFF and the second switch is ON, thereby changing an output voltage at the output terminal of the column driver from a first voltage level to a second voltage level of about one half of the maximum voltage, and produces second control signals for changing the first switch from OFF to ON, and changing the second switch from ON to OFF, thereby changing the output voltage from the second voltage level to the maximum voltage, and produces third control signals for changing the first switch from ON to OFF, and changing the second switch from OFF to ON, thereby changing the output voltage from the maximum voltage to the second voltage level, and produces fourth control signals for changing the third switch from ON to OFF, and changing the fourth switch from OFF to ON, thereby changing the output voltage from the second voltage level to the first voltage level.

3. The system according to claim 1 wherein the control circuit means produces fifth control signals for storing the voltage of about one half of the maximum voltage in the capacitor when the first switch changes form ON to OFF and the second switch changes from OFF to ON.

* * * * *